United States Patent [19]

Ullman

[11] Patent Number: 4,982,958

[45] Date of Patent: Jan. 8, 1991

[54] EXERCISE BOARD

[75] Inventor: Myron Ullman, Youngstown, Ohio

[73] Assignee: Boardman Molded Products, Inc., Youngstown, Ohio

[21] Appl. No.: 419,796

[22] Filed: Oct. 10, 1989

[51] Int. Cl.[5] ..... A63B 21/04; A63B 21/055

[52] U.S. Cl. ..... 272/138

[58] Field of Search ..... 272/134–143

[56] References Cited

U.S. PATENT DOCUMENTS

| | | | |
|---|---|---|---|
| 2,128,332 | 8/1938 | Schollmeyer | 272/142 X |
| 3,893,667 | 7/1975 | Snyder, Jr. et al. | 272/142 X |
| 4,371,162 | 2/1983 | Hartzell | 272/138 X |
| 4,466,613 | 8/1984 | Reese | 272/142 |
| 4,492,376 | 1/1985 | Schatz et al. | 272/138 |
| 4,856,775 | 8/1989 | College et al. | 272/134 |

*Primary Examiner*—Robert Bahr

*Attorney, Agent, or Firm*—Browdy and Neimark

[57] ABSTRACT

An exercising device includes an integrally molded footboard on which an individual may stand and a pair of continuous loop elastic bands attachable to the footboard and being positionable over the user's shoulders, or otherwise used by the individual for exercising purposes. The footboard is provided with a vaulted and ribbed understructure having cavities for frictionally retaining accessories including the elastic bands. Integrally molded cleats are provided at the ends of the board, and the outer shape of the board is in the rough form of an hour glass for easy carrying.

10 Claims, 5 Drawing Sheets

EXERCISE BOARD

FIELD OF INVENTION

The present invention relates to exercising devices and more particularly to an improved exercise flex board for performing squatting and similar exercises.

BACKGROUND OF THE INVENTION

An exercising device of which the present invention constitutes an improvement is shown in the Hartzell U.S. Pat. No. 4,371,162, which is hereby incorporated by reference. With reference to the attached FIGS. 1–4, which are figures from said Hartzell U.S. Pat. No. '162, such exercising device 10 includes a footboard 14 provided with a pair of continuous loop elastic bands or straps 16, 18 for positioning between the footboard 14 and the shoulders of the person 12 who wishes to exercise. As illustrated in FIGS. 1 and 2, the continuous elastic bands 16, 18 are respectively positioned in angulated slots 20, 22 and 24 provided on longitudinally opposed ends of the footboard 14, the board 14 also being provided with a base 28 which serves to elevate the footboard 14 so the ends of the straps 16, 18 will not directly contact the floor or other ground surface.

FIG. 3 is an exploded view further showing a backstrap or harness member 30 which is selectively attachable between the elastic straps 16, 18 so as to facilitate their retention on the shoulders of the user 12 as shown in FIG. 1. The backstrap 30 is provided with "Velcro" strips 32, 38, 36 which permit contact securement. Also shown are restraining bands 38, 40, e.g. rubber bands, which are intended to be stretchably positionable between the respective slots 20, 22 and 24, 26 so as to facilitate retention of the elastic straps 16, 18 within the slots once they have been so positioned. The general purpose of the exercising device 10 is to provide a construction by which an individual 12 can improve his quadraceps and gastrocnemius strength, along with his cardiovascular circulation. As stated in the Hartzell U.S. Pat. No. '162, the exercising device 10 is compact and can be used in any room in a house, or alternatively several can be used at one time in a gymnasium or similar setting.

In spite of its advantages, the device of Hartzell U.S. Pat. No. '162 has certain disadvantages as well. A major problem is that the construction of the footboard 14 is unsatisfactory. If made of a material which is sufficiently strong so as not to pose a danger to the user 12, the footboard 14 is so heavy that it is not easily portable. In addition, its shape, ignoring for the moment its weight, is such that it is difficult to carry. A further problem is that the multiple parts of the exercising device 10 require some type of container, e.g. bag or carrying case, in order to prevent its parts from becoming separated and lost during transportation and storage, and this further adds weight to the device.

SUMMARY OF THE INVENTION

It is, accordingly, an object of the present invention to overcome deficiencies in the prior art, such as indicated above.

It is another object of the invention to provide for improved portability, storage, handling, and manufacture of an exercising device of the general type disclosed in the Hartzell U.S. Pat. '162.

It is a further object of the present invention to provide an improved exercising device that is lightweight, compact, strong, durable and easily transported, and yet which is efficient and reliable in its operation.

It is still another object of the present invention to provide an improved exercising device that is easily and economically manufactured.

Yet another object of the present invention is to provide a footboard for such an exercising device which footboard is itself provided with storage space for retaining additional elements of the exercising device.

It is still a further object of the present invention to provide an improved exercising device which has all of the advantages of the device of the Hartzell U.S. Pat. No. '162 and in addition is strong, lightweight and easily portable.

These and other objects and the nature and advantages of the present invention will be apparent from the following detailed description taken in conjunction with the drawing, wherein:

Detailed Description of an Embodiment

Figure 1:
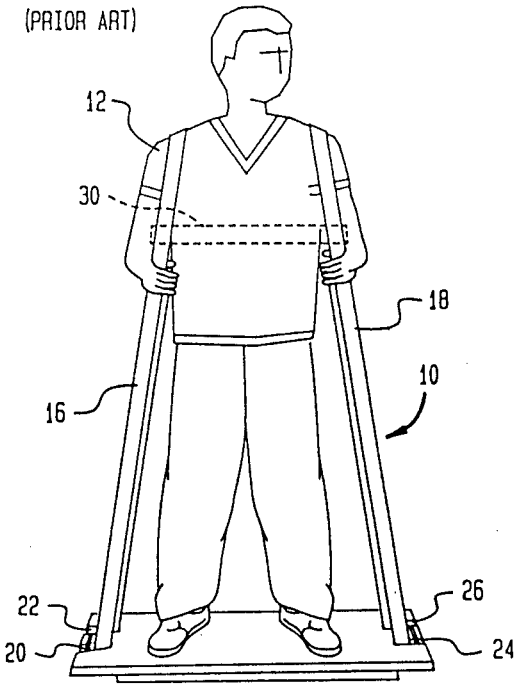
FIG. 1 (PRIOR ART)
FIGS. 1–4 illustrate the prior art device of the Hartzell U.S. Pat. No. 4,371,162 as already described above.
Figure 2:
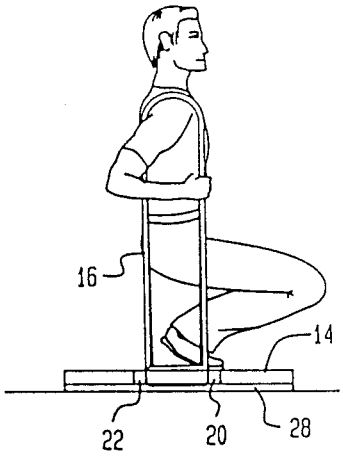
FIG. 2 (PRIOR ART)
Figure 5:
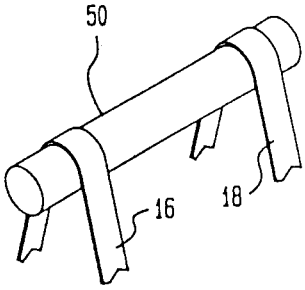
FIG. 5 is a perspective view of an exercise bar which may optionally form a part of the present invention, and which may be stored in the improved footboard of the present invention.
Figure 3:
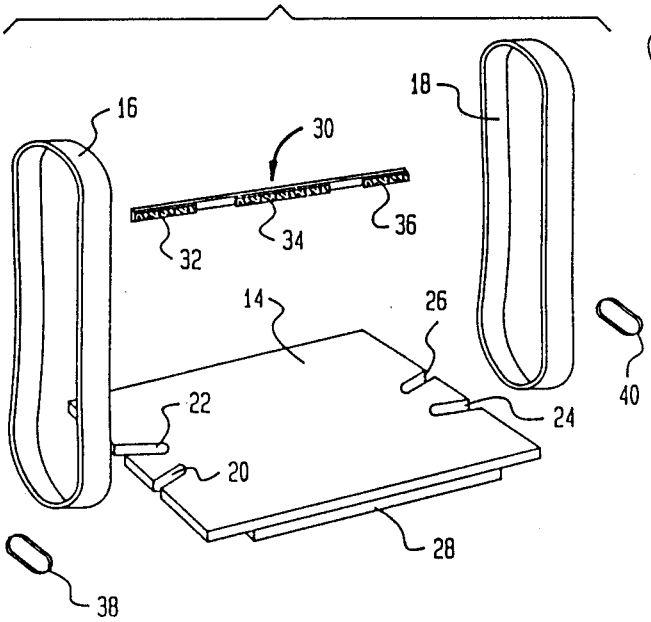
FIG. 3 (PRIOR ART)
Figure 4:
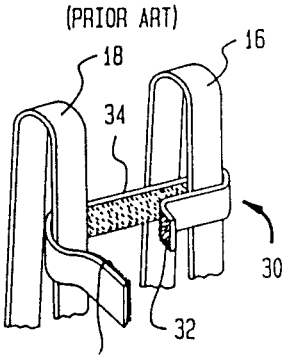
FIG. 4 (PRIOR ART)

In accordance with the present invention, there is provided an exercising device otherwise similar to that of the Hartzell U.S. Pat. No. 4,371,162, except for the structure of the footboard, and the provision of an exercise bar 50 as shown in FIG. 5. The exercise bar 50 is merely a sufficiently strong rod or pipe, preferably a plastic reinforced pipe and most preferably a pulstruded fiber reinforced plastic pipe, the pulstrusion process being well known. The purpose of the pipe 50 is merely to place through the continuous elastic bands 16, 18 and then to grasp and pull so as to carry out an exercise regimen similar to weight-lifting.

A main improvement of the present invention is, however, in the nature of the footboard. According to the present invention, a very strong, inexpensive and very light-weight (no more than about seven pounds weight) footboard 60 is provided in accordance with the present invention, the combination of light weight and high strength being provided primarily by the combination of a relatively thin, flat upper surface 62 on which a person can either stand, lie down, squat or kneel, and a lower surface which is vaulted with appropriate ribs to take out weight but add stiffness, these ribs being described in more detail below.

The board 62 is desirably injection molded in one piece from any high strength plastic such as reinforced PP, polyacetal resin, high-impact polystyrene, ABS interpolymer, etc.

Figure 6:
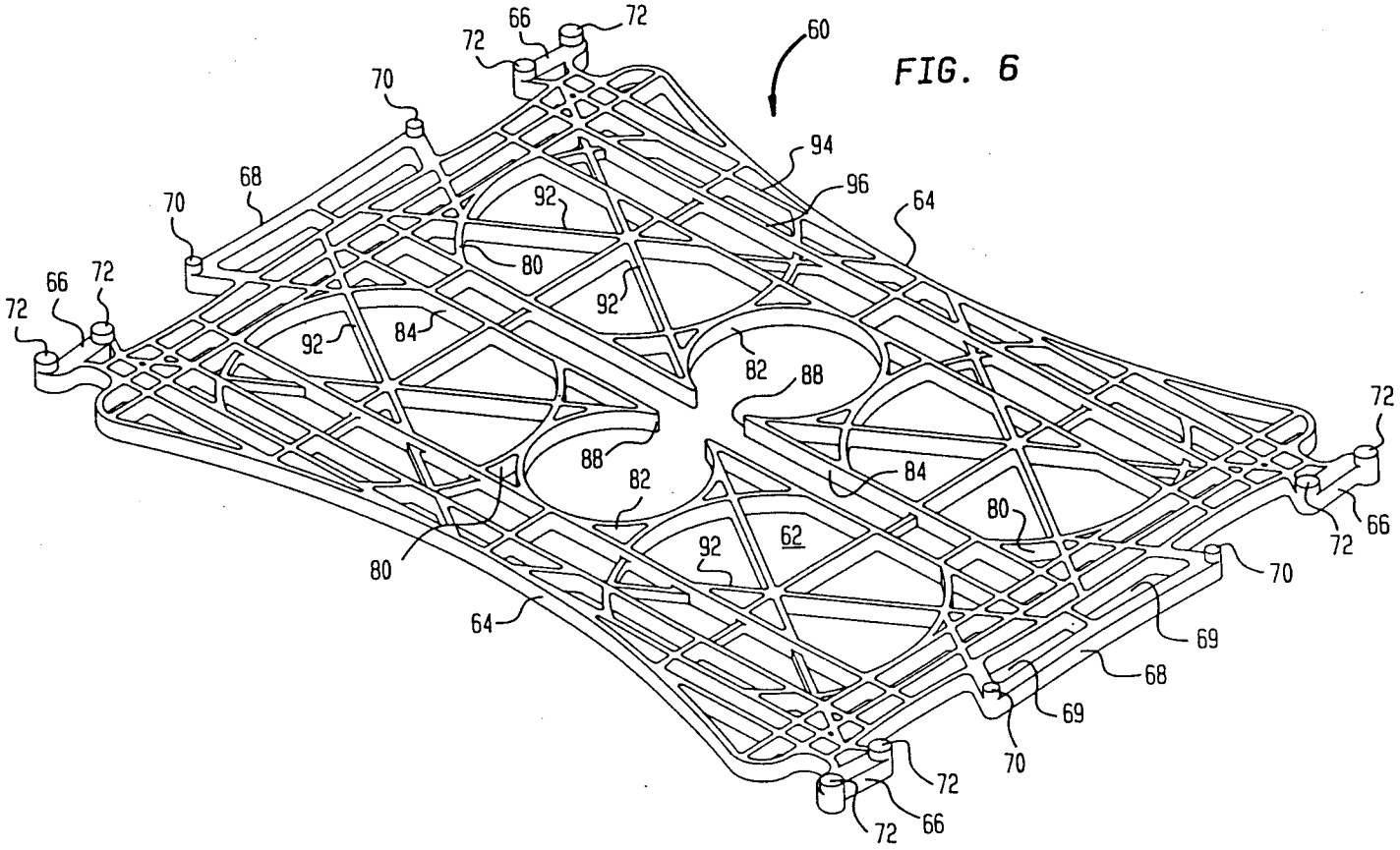
FIG. 6 is a bottom perspective view of an embodiment of an improved footboard in accordance with the present invention.
Figure 7:
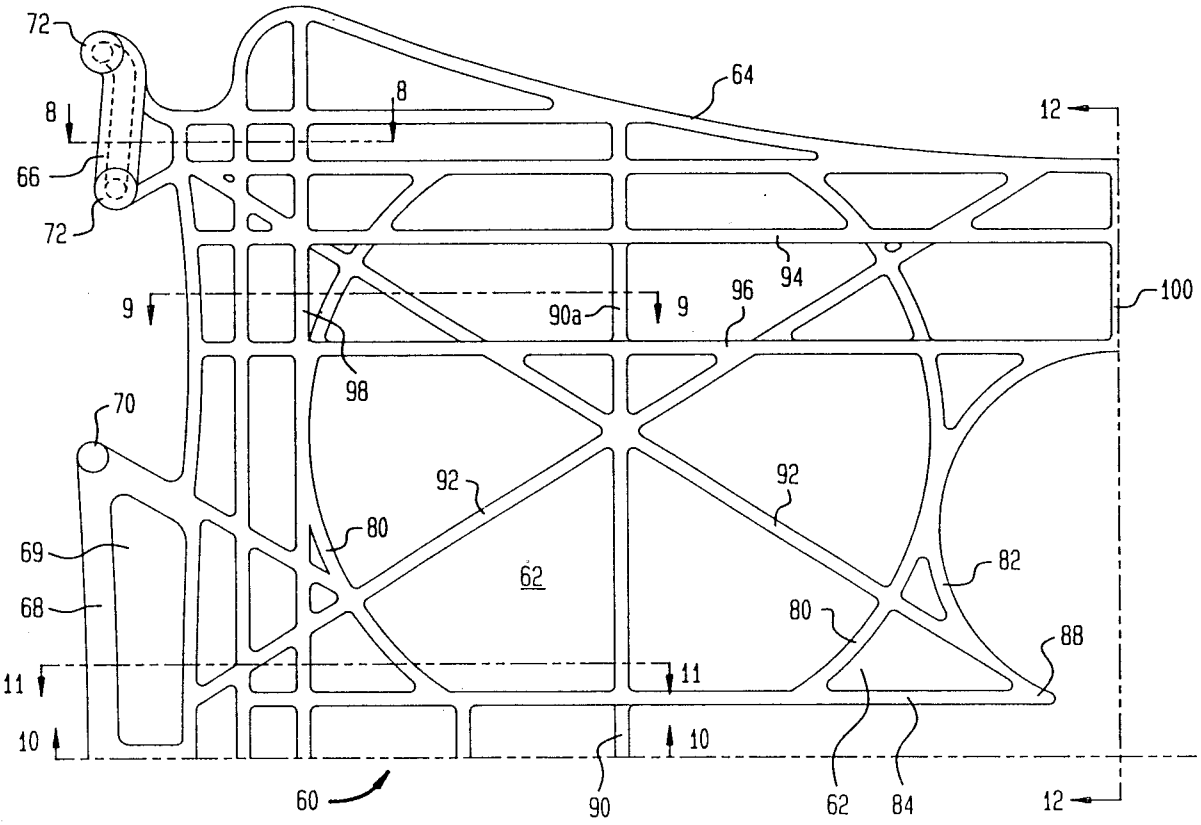
FIG. 7 is a bottom plan view of a quadrant (¼) of the board of FIG. 6.
Figure 8:
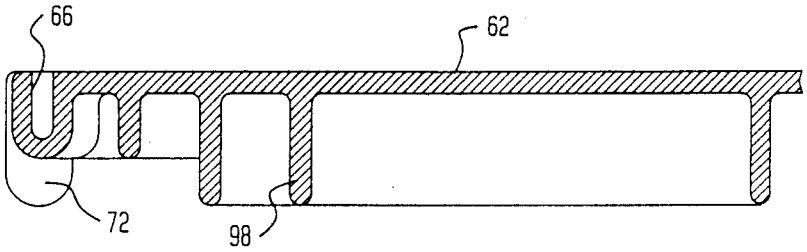
FIG. 8 is an inverted (right side up) sectional view taken along line 8—8 of FIG. 7.

As can best be seen in FIGS. 6 and 7, the board 60 has two long edges 64 which are arcuately curved so as to give the board 60 a somewhat hour glass shape, an advantage of this shape being that the board, which weighs no more than about seven pounds, can be easily carried under one's arm.

The two short ends of the footboard 60 are provided with a series of integrally molded cleats 66 and 68, preferably four smaller "half" cleats 66, one being located at each corner; and two larger full cleats 68, one each being centrally located at each end of the footboard 60. The cleats are so arranged that the thickness thereof is less than the thickness of the board 60 so that appropriate elastic bands 16, 18 or the like can be slid under the cleats and not come in contact with the supporting floor. The central full cleats 68 are provided with downwardly projecting post elements 70 at the ends thereof and the side half cleats 66 are similarly provided with similar downwardly projecting post elements 72, and these downwardly projecting post 70, 72 may also be constructed so as to stop short of the bottom surface of the footboard 60. The cleats 66 and 68 provide secure attachment for the elastic bands 16 and 18, and the small rubber bands 38, 40 of Hartzell U.S. Pat. No. '162 are not needed.

It will be readily understood that the user has the option of slipping the elastic bands 16, 18 around the central full cleats 68 inside the downward projections 70, or alternatively around both end half cleats 66 so as to effectively shorten the length of the elastic bands 18 by taking up more of their length across the transverse dimension of the footboard 60. As perhaps can be best seen in FIGS. 6 and 7, the center cleats 68 are desirably shaped so as to provide a handle for carrying and also a hook area for hanging the board on a peg when not in use by the provision of appropriate openings 69 which desirably extend entirely through the center cleats 68. It will, of course, be understood that the configuration of the cleats 66 and 68 can vary, e.g. they can be of standard cleat configuration as used in the marine industry.

Considering next the vaulted and ribbed structure of the underside of the board 60, it will be generally understood that the bottom edges of most of the ribs terminate in the same plane so that the board 60, when disposed right side up, lays flat on whatever planar surface it may be placed, such as a floor. It will also be understood in a general way that the ribs have horizontal and vertical direction in a generally uniform pattern; in this regard, it will be seen that the ribbed and vaulted structure along the bottom of the board 60 appears in the form of four quadrants, one of which is shown in FIG. 7. The quadrant diagonally opposite the illustrated quadrant is identical, and the other two quadrants are mirror images, one about a lateral centerline and the other about a longitudinal centerline.

As also can be readily seen from FIGS. 6 and 7, there are four large generally circular ribs 80 which distribute the loading horizontally and vertically over the structure, and two smaller generally circular ribs 82 which connect to a center longitudinal section defined by two longitudinally extending ribs 84 defining therebetween a cavity 86 for the frictional retention therein of the pipe 50. The two smaller generally circular ribs 82 define generally circular cavities so sized as to retain in a frictional manner the elastic bands 16 and 18 When the latter are wrapped in a spiral bundle and force fitted (wedged) in such circular spaces.

Figure 10:
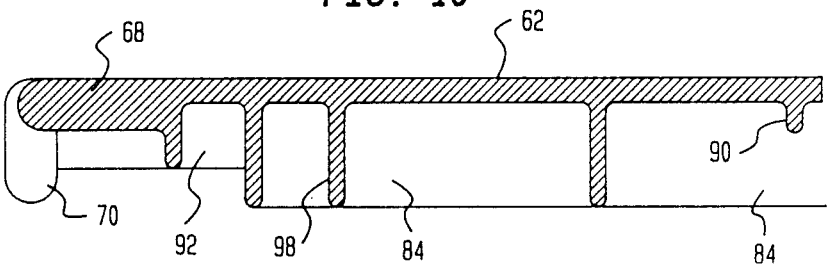
FIG. 10 is an inverted (right side up) sectional view taken along line 10—10 (the longitudinal centerline of the device) of FIG. 7.
Figure 12:
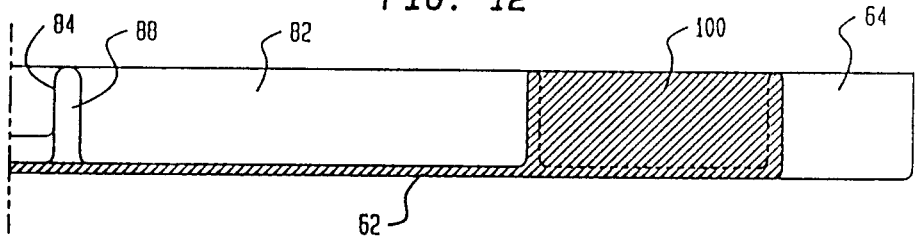
FIG. 12 is a sectional view taken along line 12—12 (the lateral centerline of the footboard) of FIG. 7.

In this regard it will be noted that each of the longitudinal ribs 84 meet at an end part thereof near the center of the board with a portion of the circular rib 82 to form a somewhat flexible nose 88 which, together with the flexible nature of the coiled elastic bands 16, 18—projecting through the gap into the longitudinal cavity 86 from the circular cavities defined by the generally circular rib 82—help ensure a good frictional interengagement among the elastic bands, the pipe 50 and the board 60 when the bands 16, 18 and the pipe 50 are stored in their respective cavities. A height shortened horizontally extending rib 90 projects across the cavity 86 and is shown in FIGS. 7 and 10, but is not illustrated in FIG. 6 for purposes of clarity.

Figure 9:
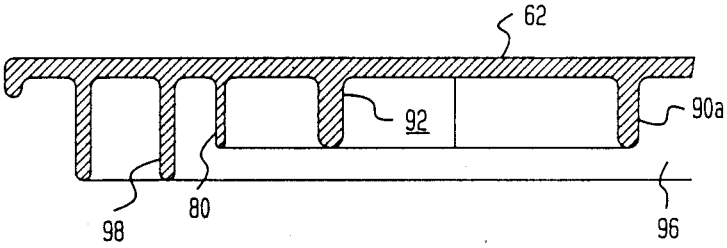
FIG. 9 is an inverted (right side up) sectional view taken along line 9—9 of FIG. 7.
Figure 11:
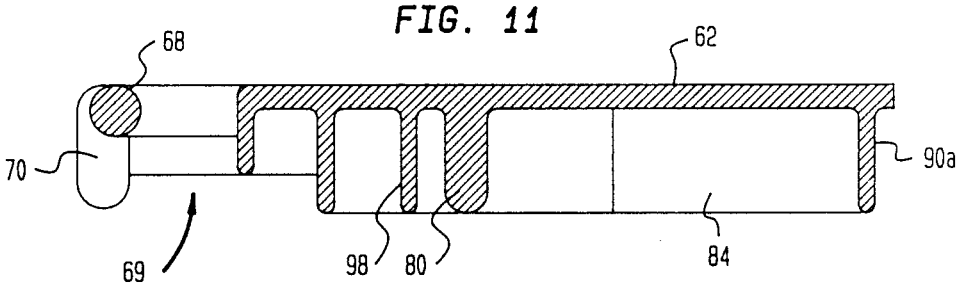
FIG. 11 is an inverted (right side up) sectional view taken along line 11—11 of FIG. 7.

As best seen in FIGS. 6 and 7, there are a number of other ribs including the diagonally extending ribs 92 which cross in an X-pattern at the center of each generally circular rib 80. Also provided are appropriate transverse and longitudinal ribs as can be readily seen. Among these are the longitudinally extending ribs 94 and 96 and the lateral or transverse ribs 98 and 100. These four ribs 94, 96, 98, 100 are of full height and define a rectangular space of width slightly less than that of the backstrap 30, and into which the backstrap 30 can be frictionally retained after folding thereof. It can be seen from FIG. 7 that other ribs can cross this recessed space, including the generally circular rib 80, the diagonal rib 92 and an extension **90*a* of the rib 90, but these ribs where they cross the recessed space for retention of the backstrap 30 are not full height ribs as is best seen in FIG. 9**.

From the description above, it is evident that the exercise flex board 60 of the present invention provides a number of advantages over the prior art, including its substantial strength, light weight, easy portability, relatively low cost in that it can be injection molded in one piece, easy storage such as by hanging from a hook or peg, and its avoidance of the necessity to have a carrying bag because the various accessories can be frictionally fitted in appropriate cavities on its underside. In addition, the board has a flat upper surface upon which a person can either stand, lie down, squat or kneel, and the upper surface of the board may be provided with interchangeable panels having appropriate logos as desired, e.g. for advertising purposes or for providing instructions of use.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In an exercising device comprising a footboard having longitudinally opposed ends each including band holding means to releasably retain elastic bands, and support means for supporting an upper surface of said footboard in space relation from a floor, and a set of continuous elastic bands for use in exercising and adapted to have portions thereof positionally received by said band holding means and having portions distal from the received portions of the elastic bands adapted to be positionally received about a user's body to facilitate said exercising, said support means supporting said upper surface of said footboard sufficiently above the floor relative to said band holding means to prevent the received portions of the elastic bands from coming into engagement with the floor, the improvement wherein said footboard comprises an integrally molded unitary element having a vaulted and ribbed undersurface, ribs of said undersurface comprising said support means, said ribs having sidewalls and being present in a pattern so as to define at least one cavity on the underside of said footboard which cavity is sized so that at least two of said sidewalls of said ribs frictionally retain a stored accessory therebetween.

2. An exercising device according to claim 1 wherein said ribs define at least two cavities, said cavities being of a size and shape adapted to frictionally retain said elastic bands in coiled or folded form.

3. An exercising device according to claim 1 wherein said ribs define at least three cavities, a first of said three cavities being of size and shape adapted to frictionally receive at least one of said elastic bands, and a second of said at least three cavities being sized and shaped so as to frictionally receive therein a backstrap construction.

4. An exercising device according to claim 1 wherein said footboard comprises two generally arcuately shaped sides so as to give said footboard a generally hour-glass shape.

5. An exercising device according to claim 1 wherein said band holding means comprise a plurality of integrally molded cleats located at each end of said footboard whereby the length of said elastic bands may be shortened or lengthened by selection of the cleats for holding the elastic bands, and wherein said cleats comprise downwardly projecting posts.

6. In an exercising device comprising a footboard having longitudinally opposed ends each including band holding means to releasably retain elastic bands, and support means for supporting an upper surface of said footboard in spaced relation from a floor, and a set of continuous elastic bands for use in exercising and adapted to have portions thereof positionally received by said band holding means and having portions distal from the received portions of the elastic bands adapted to be positionally received about a user's body to facilitate said exercising, said support means supporting said upper surface of said footboard sufficiently above the floor relative to said band holding means to prevent the received portions of the elastic bands from coming into engagement with the floor, the improvement wherein said footboard comprises an integrally molded unitary element having a vaulted and ribbed undersurface comprising said support means, and said band holding means comprise a plurality of integrally molded and downwardly projecting posts located at each end of said footboard whereby the length of said elastic bands may be shortened or lengthened by selection of the cleats for holding the elastic bands.

7. In an exercising device comprising a footboard having longitudinally opposed ends each including band holding means to releasably retain elastic bands, and support means for supporting an upper surface of said footboard in spaced relation from a floor, and a set of continuous elastic bands for use in exercising and adapted to have portions thereof positionally received by said band holding means and having portions distal from the received portions of the elastic bands adapted to be positionally received about a user's body to facilitate said exercising, said support means supporting said upper surface of said footboard sufficiently above the floor relative to said band holding means to prevent the received portions of the elastic bands from coming into engagement with the floor, the improvement wherein said footboard comprises an integrally molded unitary element having two generally arcuately shaped sides so as to give said footboard a generally hour-glass shape, and said band holding means comprise a cleat centrally located at ends of said footboard, said cleat having an opening extending therethrough and serving as means for hanging said footboard in a vertical attitude.

8. An exercising device according to claim 7 wherein said footboard has a vaulted and ribbed undersurface comprising said support means.

9. An exercising device according to claim 8 further comprising means for adjusting the length of said elastic bands comprising additional cleats located at each end of said footboard.

10. An exercising device according to claim 9 wherein said cleats each comprise a downwardly projecting post.

* * * * *